US012116794B2

(12) United States Patent
Al-Haddad et al.

(10) Patent No.: US 12,116,794 B2
(45) Date of Patent: Oct. 15, 2024

(54) SYSTEMS AND METHODS FOR REPURPOSING RETIRED WIND TURBINES AS ELECTRIC UTILITY LINE POLES

(71) Applicant: Georgia Tech Research Corporation, Atlanta, GA (US)

(72) Inventors: Tristan Al-Haddad, Atlanta, GA (US); Russell Gentry, Atlanta, GA (US); Lawrence Bank, Atlanta, GA (US); Ammar Alshannaq, Atlanta, GA (US); Jamieson Pye, Atlanta, GA (US); Mehmet Bermek, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 197 days.

(21) Appl. No.: 17/632,993

(22) PCT Filed: Aug. 5, 2020

(86) PCT No.: PCT/US2020/044949
§ 371 (c)(1),
(2) Date: Feb. 4, 2022

(87) PCT Pub. No.: WO2021/026198
PCT Pub. Date: Feb. 11, 2021

(65) Prior Publication Data

US 2022/0259883 A1 Aug. 18, 2022

Related U.S. Application Data

(60) Provisional application No. 62/882,680, filed on Aug. 5, 2019, provisional application No. 62/987,961, filed on Mar. 11, 2020.

(51) Int. Cl.
*E04H 12/02* (2006.01)
*E02D 27/42* (2006.01)
*E04H 12/24* (2006.01)

(52) U.S. Cl.
CPC ..... *E04H 12/02* (2013.01); *E04H 12/24* (2013.01)

(58) Field of Classification Search
CPC ..... H02G 7/20; E02D 27/425; E04H 12/02; E04H 12/24
See application file for complete search history.

(56) References Cited

U.S. PATENT DOCUMENTS

2005/0230980 A1 10/2005 Brunet
2006/0225278 A1* 10/2006 Lin ..... F03D 13/10 29/889.7

(Continued)

OTHER PUBLICATIONS

International Search Report and Written Opinion from Application No. PCT/US2020/044949 dated Oct. 26, 2020.

*Primary Examiner* — Hoa C Nguyen
*Assistant Examiner* — Amol H Patel
(74) *Attorney, Agent, or Firm* — Troutman Pepper Hamilton Sanders LLP; Ryan A. Schneider; Dustin B. Weeks

(57) ABSTRACT

An exemplary embodiment of the present disclosure provides an electric utility pole, comprising a beam, a base, and an arm. The beam can be formed from a retired turbine blade and can comprise a first end and a second end. The base connected to the first end of the beam. The arm can be connected to the beam. The arm can be configured to support at least one electrical conductor.

23 Claims, 7 Drawing Sheets

(56) References Cited

U.S. PATENT DOCUMENTS

| | | | | |
|---|---|---|---|---|
| 2009/0224606 | A1 | 9/2009 | Gandy | |
| 2009/0250938 | A1 | 10/2009 | Stone, Jr. | |
| 2010/0319983 | A1* | 12/2010 | De Abreu | E04H 12/20 174/45 R |
| 2011/0206506 | A1* | 8/2011 | Nies | F03D 1/065 416/1 |
| 2013/0255169 | A1* | 10/2013 | Henderson | E02D 27/32 52/223.13 |
| 2014/0083022 | A1 | 3/2014 | Nummi et al. | |
| 2017/0369377 | A1* | 12/2017 | Baltimore | C04B 14/04 |
| 2018/0100323 | A1* | 4/2018 | Burbank | H02G 7/05 |
| 2019/0066062 | A1* | 2/2019 | Lilly | G06Q 10/00 |

* cited by examiner

P (kN) $M_{edgewise}$ (kN-m)

Load Case 1: Concurrent Ice and Wind Right

P (kN) $M_{edgewise}$ (kN-m)

Load Case 2: Extreme Wind Left

SYSTEMS AND METHODS FOR REPURPOSING RETIRED WIND TURBINES AS ELECTRIC UTILITY LINE POLES

CROSS-REFERENCE TO RELATED APPLICATIONS

This application claims the benefit of U.S. Provisional Application Ser. No. 62/882,680, filed on 5 Aug. 2019, and U.S. Provisional Application Ser. No. 62/987,961, filed on 11 Mar. 2020, which are incorporated herein by reference in their entireties as if fully set forth below.

FEDERALLY SPONSORED RESEARCH STATEMENT

This invention was made with government support under Award Nos. 1701413, 1701694, and 1949818, awarded by the National Science Foundation. The government has certain rights in the invention.

TECHNICAL FIELD OF THE INVENTION

The various embodiments of the present disclosure relate generally to repurposing retired wind turbines. More particularly, the various embodiments of the present invention are directed to repurposing retired wind turbine for use as electrical utility line poles.

BACKGROUND OF THE INVENTION

Fiber-reinforced polymer (FRP) composites are attractive construction materials due to their light weight, high strength-to-weight and stiffness-to-weight ratios, fatigue strength, and durability. One major structural use for modern composite materials is in the fabrication of wind turbine blades, in which relatively thick laminates are bonded to lightweight sandwich shells in the shape of airfoils. The composite construction allows for highly complex geometries, lightweight construction and substantial fatigue resistance. However, due to the uncertainty in terms of fatigue loading, the service lives of wind blades are typically limited to 20 years, after which the wind turbine blades are typically retired. The relative short service lives of these structures in their intended role as wind turbine blades may allow for viable structural reuses, including reuse of the entire wind blade or major sections cut from the wind blade, in load-bearing applications.

Conventionally, there are three options for retired wind turbine blades, i.e., devices that were previously used as wind turbine blades but are no longer used for that purpose (e.g., decommissioned wind turbine blades). The three options are disposal, recycling, and reconfiguration/reuse. Disposal is typically accomplished through incineration or landfilling; however, this is an environmentally harmful option that has many drawbacks with little positive societal impact. Recycling can be accomplished using mechanical, thermal and chemical processing, with the extracted materials used as replacements for virgin constituents in new composites or in cementitious mortars and concretes. However, the feasibility of useful, economical extraction and the resulting mechanical property variations in composites fabricated with recycled fibers are significant issues. For the most part, FRP composites have reduced properties when manufactured with recycled fibers.

Because of the significant disadvantages associated with disposing and recycling retired wind turbine blades, there is a desire for new uses of retired wind turbine blades, particularly, where large parts of the wind blades are utilized in new or retrofitted civil infrastructure. The present disclosure addresses this desire.

BRIEF SUMMARY OF THE INVENTION

The present disclosure relates to systems and methods for repurposing retired turbine blades for use as electric utility distribution systems. An exemplary embodiment of the present invention provides an electric utility pole comprising a beam, a base, and an arm. The beam can be formed from a retired turbine blade. The beam can comprise a first end and a second end. The base can be connected to the first end of the beam. The arm can be connected to the beam and can be configured to support at least one electrical conductor.

In any of the embodiments disclosed herein, the beam can further comprise an internal cavity spanning at least a portion of the length of the beam between the first end and the second end.

In any of the embodiments disclosed herein, a portion of the internal cavity proximate the first end of the beam can be filled with self-consolidating grout.

In any of the embodiments disclosed herein, the base can further comprise one or more bars extending away from the base and into the self-consolidating grout.

In any of the embodiments disclosed herein, the base can be located beneath ground.

In any of the embodiments disclosed herein, a least a portion of the self-consolidating grout can be located beneath ground.

In any of the embodiments disclosed herein, an internal cavity of the beam can comprise a spar cap and one or more webs.

In any of the embodiments disclosed herein, an external surface of the beam can have an airfoil shape.

In any of the embodiments disclosed herein, the pole can further comprise an electrical conductor carrying an electrical current. The electrical conductor can be attached to the arm.

In any of the embodiments disclosed herein, the retired turbine blade can be a retired wind turbine blade.

In any of the embodiments disclosed herein, the beam can comprise one or more surface modifications configured to reduce lift on the beam.

In any of the embodiments disclosed herein, the one or more surface modifications can comprise one or more apertures.

In any of the embodiments disclosed herein, wherein each of the one or more apertures can comprise a first end on a first side of the beam and a second end on a second side of the beam, the first side opposing the second side.

Another embodiment of the present disclosure provides an electric utility pole comprising at least a portion of a retired wind turbine blade, a base, and an arm. The at least a portion of a retired wind turbine blade can comprise a first end and a second end. The base can be connected to the first end of the at least a portion of a retired wind turbine blade. The arm can be connected to the at least a portion of a retired wind turbine blade between the first end and the second end. The arm can support at least one electrical conductor carrying an electrical current.

In any of the embodiments disclosed herein, the at least a portion of the retired wind turbine blade can comprise an internal cavity between the first end and the second end. At least a portion of the internal cavity proximate the first end can be at least partially filled with a self-consolidating grout.

In any of the embodiments disclosed herein, the base can further comprise one or more attachment members protruding from the base and into the self-consolidating grout.

In any of the embodiments disclosed herein, the base and at least a portion of the self-consolidating grout can be positioned beneath ground level.

Another embodiment of the present disclosure provide a method of installing an electric utility pole. The method can comprise: positioning a base; providing a beam formed from a retired turbine blade, the beam having a first end and a second end; attaching the first end of the beam to the base, such that the second end of the beam extends upwards away from the base; and attaching an electrical conductor to the beam via an electrical arm connected to the beam.

In any of the embodiments disclosed herein, the method can further comprise filling at least a portion of an internal cavity of the beam proximate the first end with a self-consolidating grout.

In any of the embodiments disclosed herein, the first end of the beam can be attached to the base via a plurality of members extending from the base and into the self-consolidating grout.

In any of the embodiments disclosed herein, the internal cavity can span the length of the beam between the first end and the second end.

In any of the embodiments disclosed herein, an internal cavity of the beam can comprise a spar cap and one or more webs.

In any of the embodiments disclosed herein, the retired turbine blade can be a retired wind turbine blade.

These and other aspects of the present disclosure are described in the Detailed Description of the Invention below and the accompanying figures. Other aspects and features of embodiments of the present disclosure will become apparent to those of ordinary skill in the art upon reviewing the following description of specific, exemplary embodiments of the present disclosure in concert with the figures. While features of the present invention may be discussed relative to certain embodiments and figures, all embodiments of the present invention can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present disclosure.

BRIEF DESCRIPTION OF THE DRAWINGS

The following Detailed Description of the Invention is better understood when read in conjunction with the appended drawings. For the purposes of illustration, there is shown in the drawings exemplary embodiments, but the subject matter is not limited to the specific elements and instrumentalities disclosed.

FIG. 4 provides structural analysis of an exemplary electric utility pole, in accordance with an exemplary embodiment of the present disclosure.

DETAILED DESCRIPTION OF THE INVENTION

The components, steps, and materials described hereinafter as making up various elements of the disclosure are intended to be illustrative and not restrictive. Many suitable components, steps, and materials that would perform the same or similar functions as the components, steps, and materials described herein are intended to be embraced within the scope of the disclosure. Such other components, steps, and materials not described herein can include, but are not limited to, similar components or steps that are developed after development of the embodiments of the present disclosure.

As discussed above, due to the significant disadvantages with disposing of and recycling turbine blades (particularly wind turbine blades) that have been decommissioned or are otherwise no longer used as wind turbine blades, i.e., "retired" turbine blades, the present disclosure focuses on reusing or repurposing these retired blades for civil infrastructure applications, as these applications often involve large structures at relatively low stresses, deployed in environments where durability is often a prime concern.

The application of turbine blades for use in electric power transmission/distribution systems is promising for a number of reasons. First, power transmission structures cantilever from the ground, matching the cantilevered nature of the turbine blades. Second, power transmission structures are relatively lightly loaded compared to the first-life loads carried by wind blades on turbines-sustained loads are small. Finally, the environmental durability of the wind turbine blades may ensure that the blade poles will have a long second-lives in the expected service environment of power transmission poles.

Figure 1:
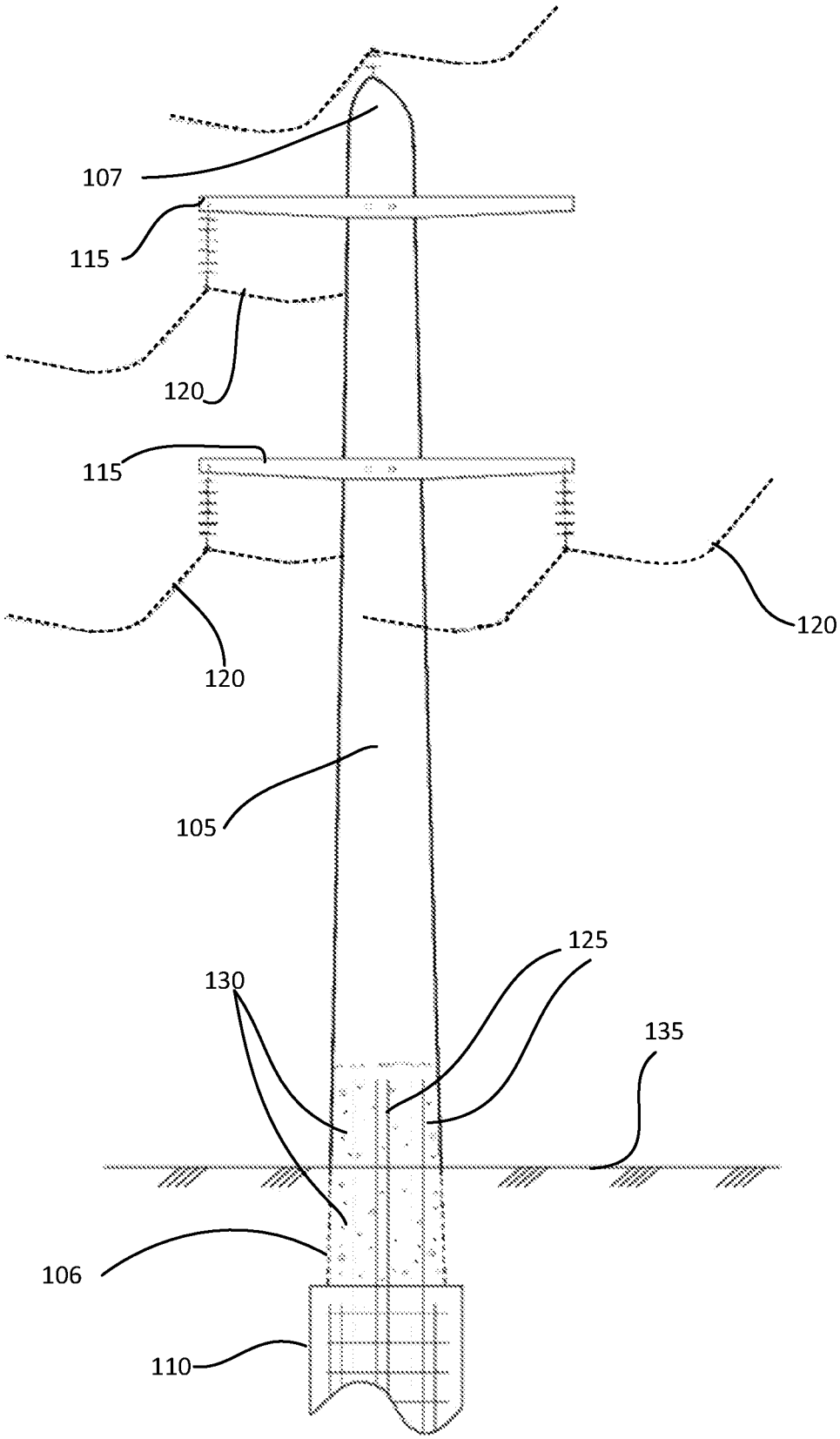
FIG. 1 provides an electric utility pole, in accordance with an exemplary embodiment of the present disclosure.

FIG. 1 provides an exemplary utility pole, in accordance with some embodiments of the present disclosure. The pole comprises a beam 105, a base 110, and one or more arms 115. The beam 105 is formed from at least a portion of a retired turbine blade. A first end 106 of the beam 105 is connected to a base 110. The second end 107 of the beam 105 extends upward. For example, as shown in FIG. 1, the base 110 is a reinforced concrete pier foundation.

The beam 105 can also comprise an internal cavity (not shown) spanning at least a portion of the length of the beam between a first end 106 and a second end 107 of the beam 105. The base 110 can be many different bases known in the art. One or more reinforcing bars 125 can extend from the base 110 and into at least a portion of the internal cavity. The portion of the internal cavity into which the reinforcing bars 125 are extended can be filled with a self-consolidating grout 130, such as concrete or cement. The combination of the grout 130 and bars 125 can be used to attach the beam 105 to the base 110.

In some embodiments, the base 110 can be positioned beneath the ground 135 (e.g., buried or at least partially buried), or otherwise anchored to the ground 135. Additionally, in some embodiments, at least a portion of the self-consolidating grout located within the internal cavity of the beam is also positioned beneath the ground level 135, as shown in FIG. 1.

The arms 115 can be used to attach an electrical conductor 120 carrying an electrical current (e.g., an electric utility power line) to the pole. The arms 115 can be made of many different materials and can be many different shapes. In some embodiments, the arms 115 can be made of FRP composites and can match the outer geometry of the beam.

Figure 2:
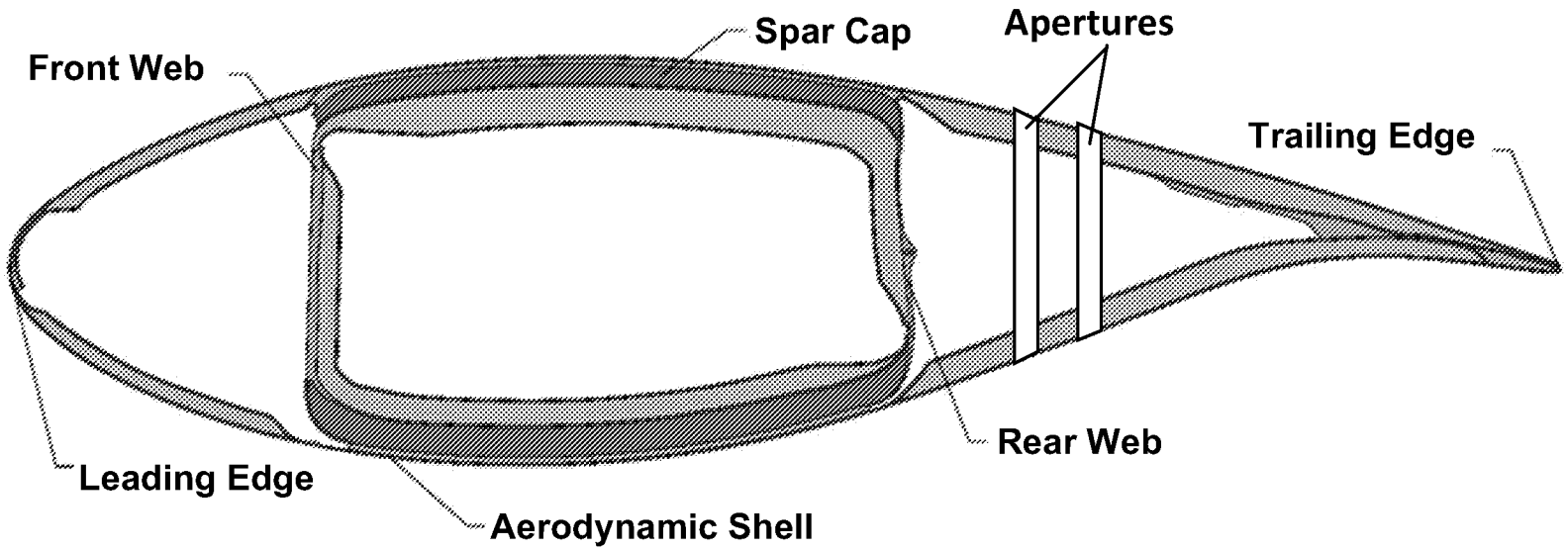
FIG. 2 provides a cross section of a wind turbine blade, in accordance with an exemplary embodiment of the present disclosure.

In some embodiments, the surface of the blade can be modified to reduce "lift" created by the passage of air over the surface of the blade. In some embodiments, the surface modifications can include one or more apertures passing between opposing sides of the blade, as shown in FIG. 2. The apertures can be at any location along the blade, in accordance with various embodiments, in some embodiments, the apertures can be located between the rear web and the trailing edge. In some embodiments, the apertures can be substantially parallel to the rear web. In other embodiments, other surface modifications can exist. For example, a rough coating can be applied to the surface of the blade, which can assist with disrupting laminar flow of air over the surface of the blade. In some embodiments, one or more indentions, protrusions, and/or projections can be positioned on the blade to reduce lift.

The internal geometry of a turbine blade will now be discussed. A cross section of a wind blade (except the root which is typically a circular shell) contains three primary components: an aerodynamic shell, a load-bearing spar cap, and shear-bearing webs. Through visual inspection of the actual cross section illustrated in FIG. 2, the thickest and stiffest part of the cross section is the spar cap, which serves as the primary load-bearing "member" of the overall cross section. The webs are used for shear-bearing as well as structural stability of the airfoil shape. The aerodynamic shell is the shape that gives the blade its ability to move with the wind in an efficient manner as well as giving additional resistance to shear and torsional loads.

Figure 3:
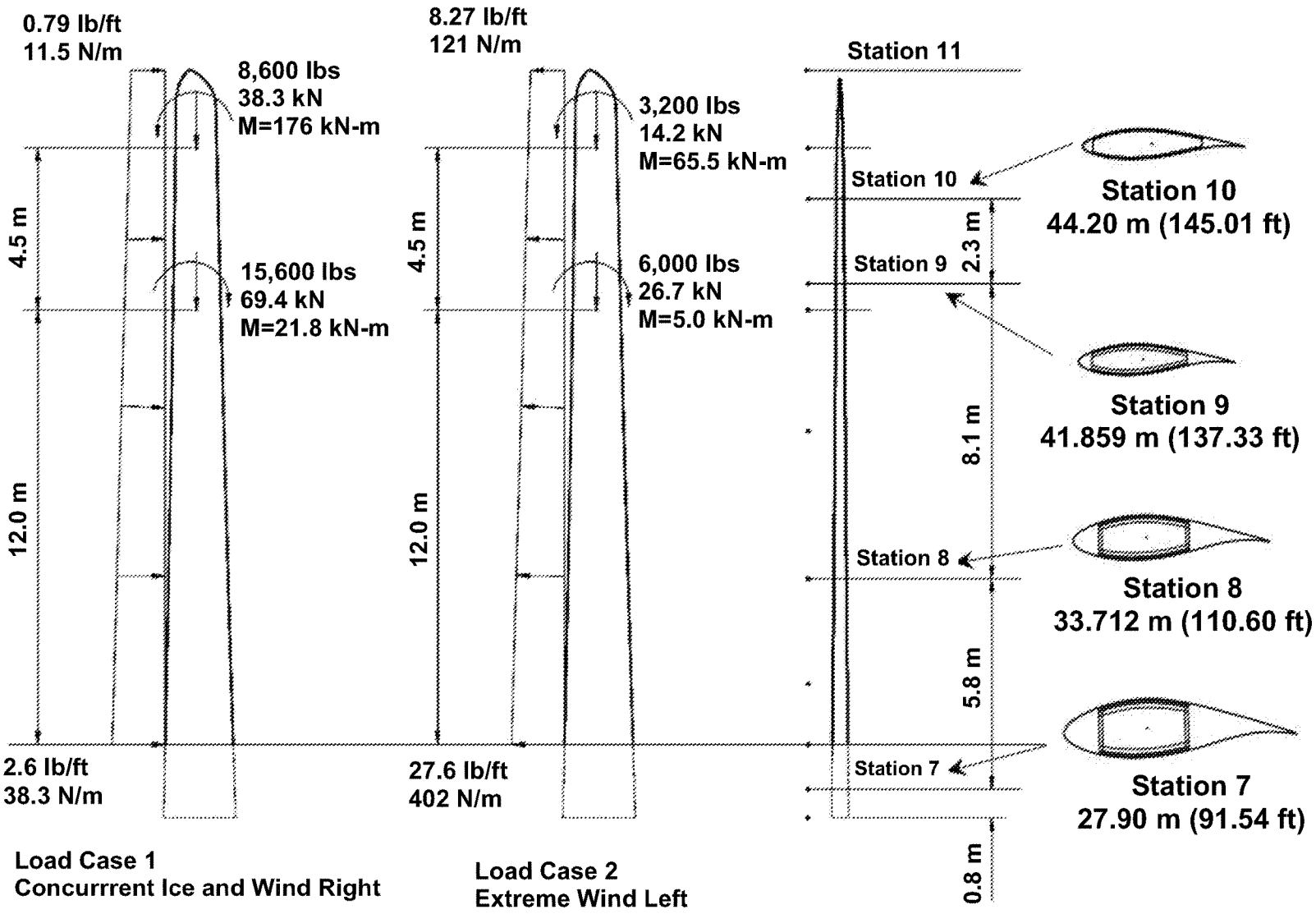
FIG. 3 provides an illustration of two load cases experienced by an electric utility pole, in accordance with an exemplary embodiment of the present disclosure.
Figure 4A:
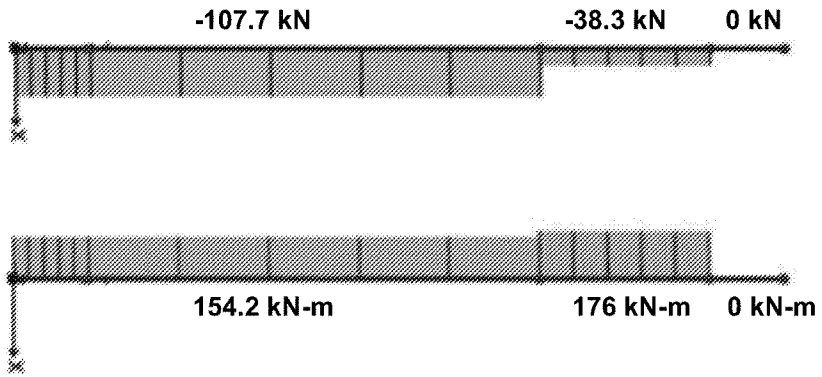
FIG. 4A illustrates axial load and edgewise bending moment from load case 1.
Figure 4B:
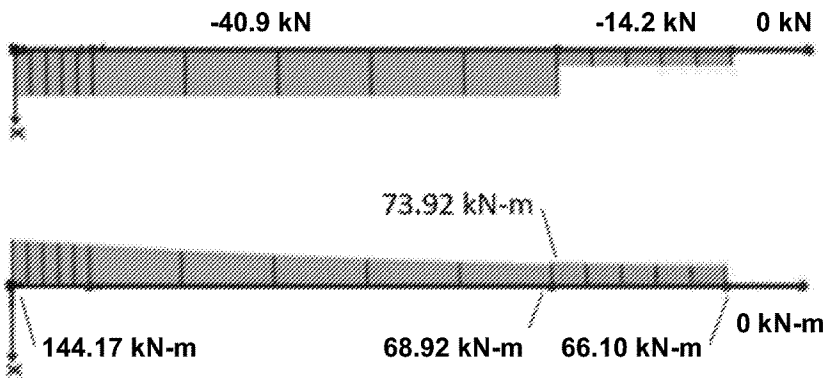
FIG. 4B illustrates axial load and edgewise bending moment from load cases 2.
Figure 4C:
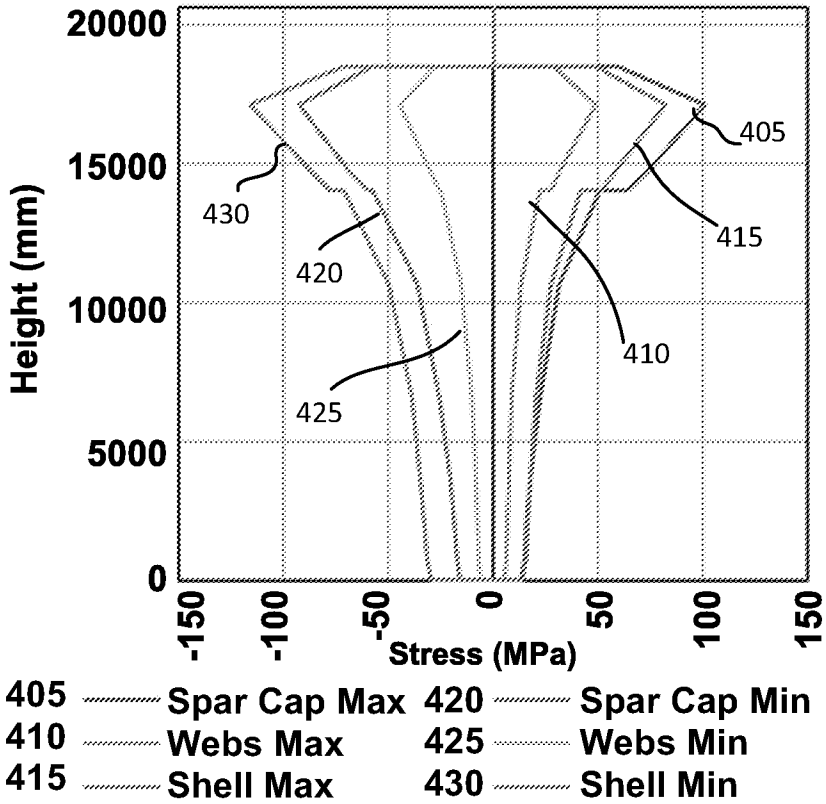
FIG. 4C and 4D illustrate stress distribution along the used wind blade part due to load case 1 and 2, respectively.
Figure 4D:
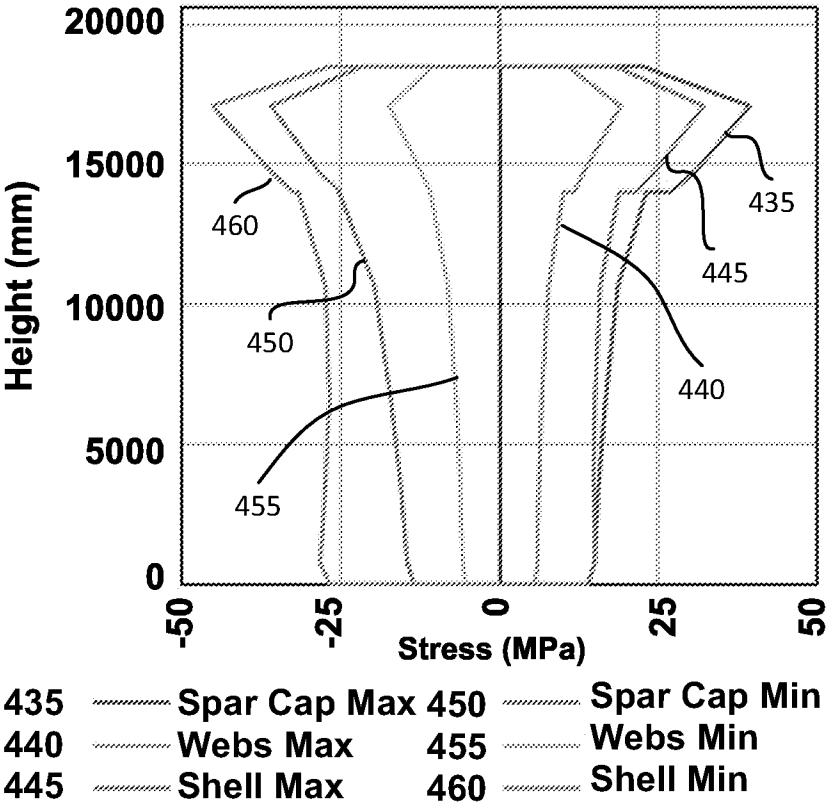

The structural analysis of an exemplary utility power pole will now be discussed. ASCE 74 (2009) designates the standards for the structural analysis of any power line project. The loading identifies cases at which one or more of the following situations may occur; extreme wind, extreme ice, combination of both wind and ice, differential ice, and broken conductors and/or shields (i.e. differential loading). When combined, these result in 16 load combinations. After analyzing all the combinations, two were found to control the design. These give the highest stresses and strains in the exemplary power pole, as shown in FIG. 3. The two load cases were: "Concurrent ice and wind right" (load case 1), and "extreme wind left" (load case 2). FIGS. 4A and 4B show the expected axial loads and edgewise bending moments (i.e., moment about the vertical axis that passes through the centroid of the cross section in FIG. 2) due to these two load cases, respectively. FIGS. 4C and 4D show the resulting stresses across the different parts composing the wind blade due to the two load cases, respectively. Note that the two locations where stresses drop suddenly occur at the attachment points of the crossarms on the power pole structure. As shown in FIG. 4, load case 1 is the critical case resulting in maximum tensile stresses of 100.99 MPa and 82.2 MPa in the spar cap and the shell, respectively, of the exemplary pole. The maximum compressive stresses on the spar cap and shell are 92.6 MPa and 115.9 MPa, respectively. In order to get an insight into the factor of safety and the strength utilization ratio of the composite materials forming the wind blade, coupon testing of samples taken from critical locations (i.e. shell, spar cap, and web) were carried out.

Figures 5A, 5B:
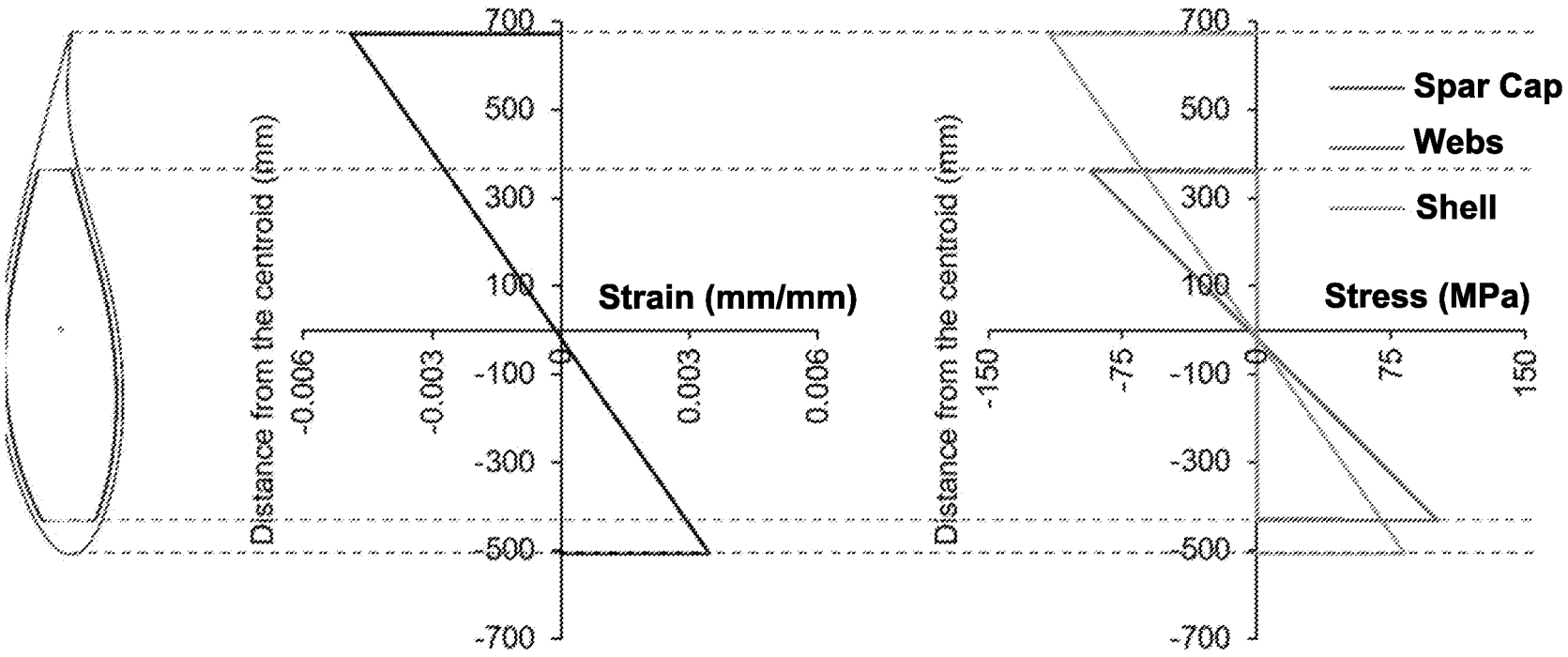
FIGS. 5A-5B illustrate strains and stresses at the critical section due to load case 1.
Figures 5C, 5D:
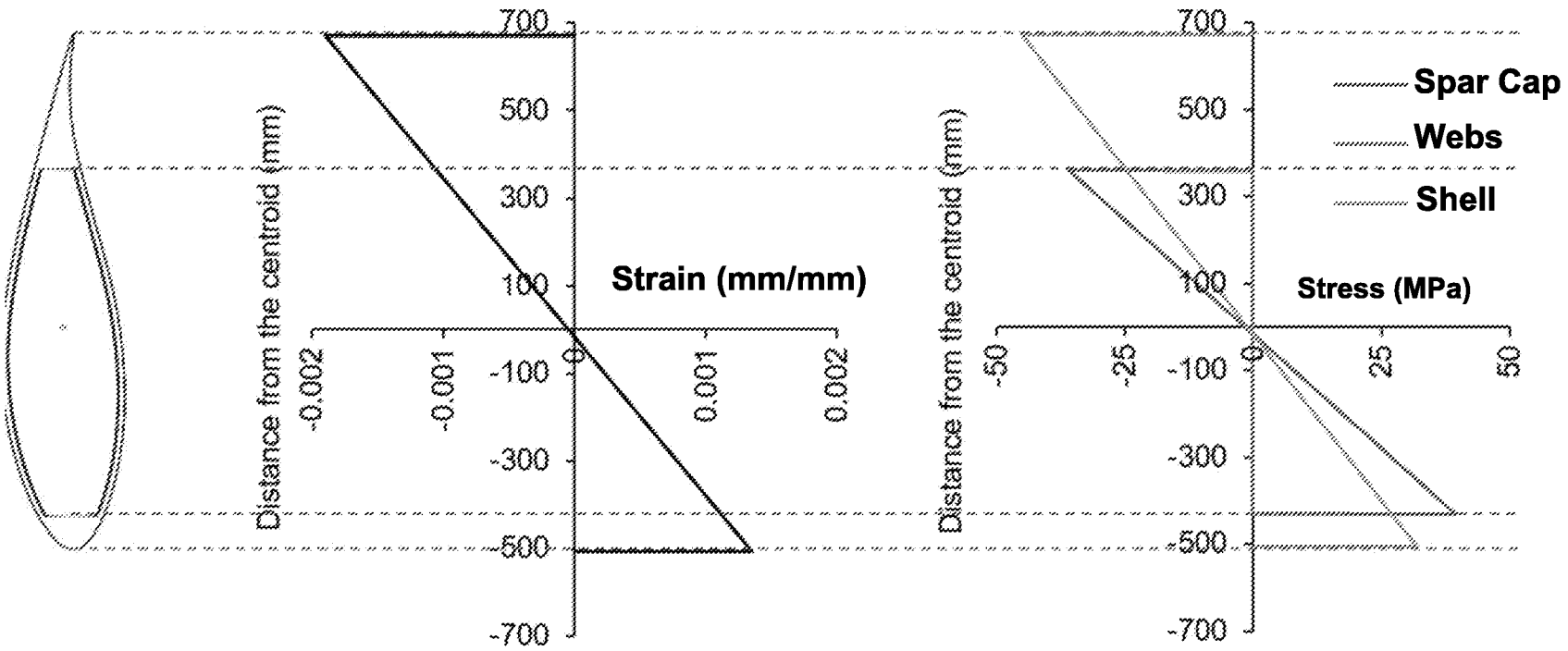
FIGS. 5C-D illustrate strains and stresses at the critical section due to load case 2, in accordance with an exemplary embodiment of the present disclosure.

FIGS. 5A and 5B show the strain and stress distributions at the critical section (44,200 mm from the root and 18,490 mm from base of blade part used) for load case 1. FIGS. 5C and 5D show these distributions for load case 2. As can be seen in the figures, even though the distance from the centroid is higher for the shell (due to the nature of the airfoil shape), the tensile stresses are higher in the spar cap due to its higher stiffness (i.e., stiffer parts attract higher loads). However, this is not the case for the compressive stresses.

The first-life design of wind blades focuses on the aerodynamic shell being able to adequately move with the wind without structural failure. In contrast, power pole configurations of the present disclosure can aim at exploiting the high strength and stiffness of the load-bearing spar cap. This makes the spar cap a primary focus of the testing and safety checks for the configuration (i.e., it is assumed that even if the shell fails either in tension or compression, this will not compromise the safety of the power pole).

To determine the viability of the exemplary utility pole, measured strength values for the material were checked against expected critical stresses on the power pole structure. Samples were taken from the spar cap of the wind blade to measure the longitudinal strength and stiffness of the material. However, there is some ambiguity in the ASTM standards (ASTM-D695 2015, ASTM-D3410 2016, and ASTM-D6641 2016) for compressive testing of FRP samples in terms of; thick samples (higher than 2 mm), gripping pressure, and load introduction technique (D695-end bearing, D3410-shear loading, D6641-shear and end bearing). As such, an initial series of experiments were performed to identify proper gripping pressure and testing fixture to be used in the actual testing program for the wind blade samples. No tabs were used in the testing program.

The average compressive strength of eight tested samples was 347 MPa with a coefficient of variation (COV) of 17.5%. The COV is relatively high which can be attributed to the variability in testing (i.e., different gripping pressures and different end conditions). The longitudinal modulus of elasticity was calculated from the measured stress-strain curves between 1000με and 3000με and found to be 36.1 GPa.

The strength values from the mechanical tests can be compared with the expected critical stresses to obtain first-approximations of factors of safety and strength utilization ratios. Using the average compressive strength of 347 MPa results in a factor of safety (F.S) of 3.75 or a strength utilization ratio of 0.27 for the power pole configuration under the critical load case. These values are considered within the acceptable range for civil engineering infrastructure. Since test results for the laminate in the shell were not conducted, Helius Composites software (Audodesk 2016) was used to predict the theoretical compressive strength of a specimen taken from the shell at the critical stress location (18,490 mm from base of blade part used). The compressive strength of the shell was found to be 202 MPa and the corresponding factor of safety (F.S) was 1.75.

It is to be understood that the embodiments and claims disclosed herein are not limited in their application to the details of construction and arrangement of the components set forth in the description and illustrated in the drawings. Rather, the description and the drawings provide examples of the embodiments envisioned. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the United States Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. Instead, it is intended that the invention is defined by the claims appended hereto.

What is claimed is:

1. In a system comprising:

a composite material structure;

wherein:

the composite material structure comprises at least a portion of a decommissioned turbine blade;

the decommissioned turbine blade has a blade design based upon turbine blade performance, enabling use of the turbine blade with a turbine that extracts energy from a fluid flow and converts it into useful work;

the blade design of the decommissioned turbine blade renders the composite material structure incompatible for use in an electric utility pole of an electric power transmission/distribution system; and conventional second-life options for a conventional decommissioned turbine blade that is no longer used with a turbine include disposal of the conventional decommissioned turbine blade or rendering the conventional decommissioned turbine blade into constituents;

the improvement comprising structural repurposing that transforms the composite material structure into an improved composite material structure, wherein the improved composite material structure comprising the decommissioned turbine blade is compatible for use in an electric utility pole of an electric power transmission/distribution system;

wherein:

the improved composite material structure is a vertical, load-bearing component of an electric utility pole, the improved composite material structure having a second-life design based upon electric utility pole performance, enabling the improved composite material structure to form a beam of the electric utility pole; and an improved second-life option for the conventional decommissioned turbine blade that is no longer used with a turbine includes repurposing the conventional decommissioned turbine blade via the structural repurposing into a component of the improved composite material structure having the second-life design based upon electric utility pole performance.

2. The improved system of claim 1, wherein the beam comprises an internal cavity spanning at least a portion of the length of the beam between a first end and a second end of the beam.

3. The improved system of claim 2, wherein at least a portion of the internal cavity proximate the first end of the beam is filled with self-consolidating grout.

4. The improved system of claim 3 further comprising a base connected to the first end of the beam;

wherein the base comprises one or more bars extending away from the base and into the self-consolidating grout.

5. The improved system of claim 3, wherein a least a portion of the self-consolidating grout is located beneath ground.

6. The improved system of claim 1 further comprising a base connected to a first end of the beam;

wherein the base is located beneath ground.

7. The improved system of claim 1, wherein an internal cavity of the beam comprises a spar cap and one or more webs.

8. The improved system of claim 1, wherein an external surface of the beam has an airfoil shape.

9. The improved system of claim 1 further comprising an electrical conductor.

10. The improved system of claim 1, wherein the decommissioned turbine blade is a decommissioned wind turbine blade previously used with a wind turbine to collect kinetic energy of wind moving past the wind turbine blade.

11. An electric utility pole of comprising:

a beam spanning a length between a first end configured to be in proximity to ground and a second end of the beam configured to be distal the ground;

an arm connected to the beam in proximity of the second end of the beam, the arm configured to support at least one electrical conductor; and structural repurposing:

wherein:

the electric utility pole is configured to form part of an electric power transmission/distribution system;

the beam comprises a retired turbine blade;

the retired turbine blade has a first-life design based upon turbine blade performance, which first-life design of the retired turbine blade is incompatible for use in a beam of an electric utility pole of an electric power transmission/distribution system;

the structural repurposing enables the use of the retired turbine blade in the beam of the electric utility pole; and the conversion technology comprises one or more of:

self-consolidating grout, wherein the beam comprises an internal cavity spanning at least a portion of the length of the beam, and wherein at least a portion of the internal cavity proximate the first end of the beam is filled with the self-consolidating grout;

a base, one or more bars, and the self-consolidating grout, wherein the base is connected to the first end of the beam, and wherein one or more of the bars extend away from the base and into the self-consolidating grout; or the beam comprises one or more surface modifications configured to reduce lift on the beam.

12. The pole of claim 11, wherein the one or more surface modifications comprise one or more apertures.

13. The pole of claim 12, wherein at least a portion of the one or more apertures each comprise a first end on a first side of the beam, and a second end on a second side of the beam, the first side opposing the second side.

14. An electric utility pole comprising:

a beam structure comprising at least a 12 meter portion of a retired wind turbine blade, the beam structure extending from a first end and a second end;

a base connected to the first end;

a structural repurposing system; and an arm connected to the beam structure between the first end and the second end, the arm configured to support at least one electrical conductor;

wherein the retired wind turbine blade has a first-life design based upon wind turbine blade performance, which first-life design of the retired wind turbine blade is incompatible for use in a beam of an electric utility pole; and wherein the structural repurposing system enables the use of the retired wind turbine blade in the beam of the electric utility pole.

15. The pole of claim 14, wherein the beam structure comprising the portion of the retired wind turbine blade comprises an internal cavity; and wherein the structural repurposing system comprises at least a portion of the internal cavity proximate the first end being at least partially filled with a self-consolidating grout.

16. The pole of claim 15, wherein the structural repurposing system further comprises one or more attachment members protruding from the base and into the self-consolidating grout.

17. The pole of claim 16, wherein the base and at least a portion of the self-consolidating grout is positioned beneath ground level.

18. A method of installing an electric utility pole comprising:

attaching a first end of a beam of which at least a portion comprises an intact, 12 meter or longer portion of a retired turbine blade to a base, such that a second end of the beam extends from the base; and attaching an electrical conductor to the beam.

19. The method of claim 18, wherein the second end of the beam extends upwards away from the base; and wherein at least a portion of an internal cavity of the beam proximate the first end has self-consolidating grout.

20. The method of claim 19 further comprising:

positioning the base; and filling the portion of the internal cavity of the beam proximate the first end with the self-consolidating grout;

wherein attaching the first end of the beam to the base comprises attaching the first end of the beam to the base via a plurality of members extending from the base and into the self-consolidating grout.

21. The method of claim 19, wherein the internal cavity spans the length of the beam between the first end and the second end.

22. The method of claim 18, wherein an internal cavity of the beam comprises a spar cap and one or more webs.

23. The method of claim 18, wherein the retired turbine blade is a retired wind turbine blade.

* * * * *